US012371141B1

(12) United States Patent
Wald et al.

(10) Patent No.: US 12,371,141 B1
(45) Date of Patent: Jul. 29, 2025

(54) MARINE DRIVES HAVING CORROSION PROTECTION SYSTEM WITH NOISE AND VIBRATION DAMPENING JOINT

(71) Applicant: Brunswick Corporation, Mettawa, IL (US)

(72) Inventors: Benjamin C. Wald, Perkins, OK (US); Duane Harding, Stillwater, OK (US)

(73) Assignee: Brunswick Corporation, Mettawa, IL (US)

( * ) Notice: Subject to any disclaimer, the term of this patent is extended or adjusted under 35 U.S.C. 154(b) by 445 days.

(21) Appl. No.: 17/891,966

(22) Filed: Aug. 19, 2022

(51) Int. Cl.

| | |
|---|---|
| ***B63H 21/30*** | (2006.01) |
| ***B63B 59/04*** | (2006.01) |
| ***B63H 20/00*** | (2006.01) |
| ***B63H 20/06*** | (2006.01) |

(52) U.S. Cl.
CPC ..... *B63H 21/305* (2013.01); *B63H 20/007* (2013.01); *B63H 20/06* (2013.01); *B63B 59/04* (2013.01)

(58) Field of Classification Search
CPC .... B63H 21/305; B63H 20/007; B63H 20/06; B63B 59/04
See application file for complete search history.

(56) References Cited

U.S. PATENT DOCUMENTS

| | | | |
|---|---|---|---|
| 3,853,730 | A | 12/1974 | Anderson |
| 3,953,742 | A | 4/1976 | Anderson et al. |
| 3,954,082 | A | 5/1976 | Roller |
| 3,995,513 | A | 12/1976 | Amdall |
| 4,322,633 | A | 3/1982 | Staerzl |
| 4,492,877 | A | 1/1985 | Staerzl |
| 4,528,460 | A | 7/1985 | Staerzl |
| 4,632,487 | A | 12/1986 | Wargula |
| 4,787,868 | A | 11/1988 | Hoshiba |

(Continued)

FOREIGN PATENT DOCUMENTS

| | | |
|---|---|---|
| CA | 1040134 | 10/1978 |
| CA | 1056766 | 6/1979 |
| GB | 2133592 | 8/1986 |

OTHER PUBLICATIONS

Unpublished U.S. Appl. No. 17/469,479.

(Continued)

*Primary Examiner* — Stephen P Avila
(74) *Attorney, Agent, or Firm* — Andrus Intellectual Property Law, LLP

(57) ABSTRACT

A system for antifouling of a marine drive having a frame coupled to a propulsor housing may include a vibration dampening joint which couples the propulsor housing to the frame or an extension thereof. The vibration dampening joint may include an isolator connector assembly having an elastomeric member which is clamped between the propulsor housing and the frame or the extension thereof such that all vibrations emanating from the propulsor housing pass through the elastomeric member. A power source for providing electricity may be supported on the frame. An electric circuit may have a first end coupled to the power source and an opposite, second end coupled to the propulsor housing. The electric circuit may be configured to convey electricity from the power source to the propulsor housing and thus prevent fouling thereof, wherein the electric circuit extends through the vibration dampening joint.

20 Claims, 10 Drawing Sheets

FIG. 1

(56) References Cited

U.S. PATENT DOCUMENTS

| | | | | |
|---|---|---|---|---|
| 4,897,059 | A | 1/1990 | Newman | |
| 4,969,847 | A * | 11/1990 | Curtis | F16L 35/00 123/195 P |
| 5,188,548 | A | 2/1993 | Ferguson et al. | |
| 5,192,235 | A | 3/1993 | Dunham et al. | |
| 5,219,306 | A | 6/1993 | Takahashi | |
| 5,511,997 | A | 4/1996 | Yoshida | |
| 5,747,892 | A | 5/1998 | Staerzl | |
| 5,840,164 | A | 11/1998 | Staerzl | |
| 6,183,625 | B1 | 2/2001 | Staerzl | |
| 6,209,472 | B1 | 4/2001 | Staerzl | |
| 6,547,952 | B1 | 4/2003 | Staerzl | |
| 6,559,660 | B1 | 5/2003 | Staerzl | |
| 6,822,462 | B1 | 11/2004 | Staerzl | |
| 6,913,498 | B1 | 7/2005 | Sheth | |
| 7,064,459 | B1 | 6/2006 | Staerzl | |
| 7,131,877 | B1 | 11/2006 | Staerzl | |
| 7,305,928 | B2 | 12/2007 | Bradley et al. | |
| 7,381,312 | B1 | 6/2008 | Misorski et al. | |
| 7,387,553 | B1 | 6/2008 | Misorski et al. | |
| 7,896,304 | B1 | 3/2011 | Eichinger et al. | |
| 8,118,983 | B1 | 2/2012 | Anderson et al. | |
| 8,372,260 | B1 | 2/2013 | Staerzl et al. | |
| 9,168,979 | B1 | 10/2015 | Schueller et al. | |
| 9,446,828 | B1 | 9/2016 | Groeschel et al. | |
| 9,701,383 | B1 | 7/2017 | Stuber et al. | |
| 9,764,813 | B1 | 9/2017 | Zarembka et al. | |
| 9,963,213 | B1 | 5/2018 | Jaszewski et al. | |
| 10,202,180 | B1 | 2/2019 | Amerling et al. | |
| 10,246,173 | B1 | 4/2019 | Ingebritson | |
| 10,696,367 | B1 | 6/2020 | Ingebritson et al. | |
| 10,787,236 | B1 | 9/2020 | Erickson et al. | |
| 10,981,637 | B1 | 4/2021 | Alby et al. | |
| 11,097,826 | B1 | 8/2021 | Dannenberg et al. | |
| 11,180,235 | B2 | 11/2021 | Wiatrowski | |
| 11,186,352 | B1 | 11/2021 | Erickson et al. | |
| 11,214,346 | B1 | 1/2022 | Jaeger et al. | |
| 2017/0129577 | A1 * | 5/2017 | Mizutani | B63H 20/06 |
| 2019/0061512 | A1 | 2/2019 | Noguez | |

OTHER PUBLICATIONS

Unpublished U.S. Appl. No. 17/487,116.
Unpublished U.S. Appl. No. 17/509,739.
Unpublished U.S. Appl. No. 17/550,463.
Unpublished U.S. Appl. No. 17/554,540.
Unpublished U.S. Appl. No. 17/585,214.
Unpublished U.S. Appl. No. 17/671,041.
Declaration of Prior Art signed by inventor Benjamin C. Wald on Sep. 2, 2022.

* cited by examiner

MARINE DRIVES HAVING CORROSION PROTECTION SYSTEM WITH NOISE AND VIBRATION DAMPENING JOINT

FIELD

The present disclosure relates to marine drives for propelling a marine vessel in water, and more particularly to corrosion protection for such marine drives having one or more noise and vibration dampening joints.

BACKGROUND

It is known that providing an electric current proximate an underwater surface in a saltwater environment inhibits and deters the growth of marine organisms, such as barnacles. It is believed that certain marine organisms, such as barnacles, abhor chlorine. When electric current is provided in a saltwater environment, the current interacts with the surrounding saltwater and produces chlorine gas, among other things, in the form of chemically adsorbed species and bubbles at the underwater surface. The production of chlorine increases with the current flow.

The following U.S. Patents and U.S. Patent Applications are incorporated herein by reference. Several of the patents and patent applications disclose marine drives, generally. Several of the patents also disclose anti-fouling systems and methods for marine structures, including for example cathodic protection systems.

U.S. Pat. No. 3,953,742 discloses a cathodic protection system monitor that is coupled to an impressed current cathodic protection circuit and used for corrosion protection of a submerged marine drive. The cathodic protection circuit includes one or more anodes and a reference electrode mounted below the water line and connected to an automatic controller for supplying an anode current which is regulated in order to maintain a predetermined reference potential on the protected structure. A switch selectively connects a light emitting diode (LED) lamp or other light source between the controller output and ground so that the controller current may, when tested, be used to operate the light source in order to confirm that power is available to the anode.

U.S. Pat. No. 4,492,877 discloses an electrode apparatus for mounting an anode and reference electrode of a cathodic protection system on an outboard drive unit. The apparatus includes an insulating housing on which the anode and reference electrode are mounted and a copper shield mounted between the anode and electrode to allow them to be mounted in close proximity to each other. The shield is electrically connected to the device to be protected and serves to match the electrical field potential at the reference electrode to that of a point on the outboard drive unit remote from the housing.

U.S. Pat. No. 4,528,460 discloses a control system for cathodically protecting an outboard drive unit from corrosion, which includes an anode and a reference electrode mounted on the drive unit. Current supplied to the anode is controlled by a transistor, which in turn is controlled by an amplifier. The amplifier is biased to maintain a relatively constant potential on the drive unit when operated in either fresh or salt water.

U.S. Pat. No. 6,183,625 discloses a galvanic monitor system that uses two annunciators, such as light emitting diodes, to alert a boat operator of the current status of the boat's galvanic protection system. A reference electrode is used to monitor the voltage potential at a location in the water and near the component to be protected. The voltage potential of the electrode is compared to upper and lower limits to determine if the actual sensed voltage potential is above the lower limit and below the upper limit. The two annunciators lights are used to inform the operator if the protection is proper or if the component to be protected is either being over protected or under protected.

U.S. Pat. No. 6,209,472 discloses a system for inhibiting marine organism growth on underwater surfaces. The system provides an electric current generator which causes an electric current to flow proximate the underwater surface. A source of power, such as a battery, provides electrical power to the electric current generator. The flow of current passes from the underwater surface through water surrounding the surface or in contact with the surface, and a point of ground potential. The point of ground potential can be a marine propulsion system attached to a boat on which the underwater surface is contained.

U.S. Pat. No. 7,131,877 discloses a marine cathodic protection system that maintains a submerged portion of a marine drive unit at a selected potential to reduce or eliminate corrosion thereto. An anode is energized to maintain the drive unit at a preselected constant potential in response to the sensed potential at a closely located reference electrode during normal operations. Excessive current to the anode is sensed to provide a maximum current limitation. An integrated circuit employs a highly regulated voltage source to establish precise control of the anode energization.

U.S. Pat. No. 7,305,928 discloses a vessel positioning system that maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. Pat. No. 7,381,312 discloses a ceramic conductor, which is supported by an electrically insulative support member for attachment directly to a marine propulsion drive and for use as either an anode or electrode in a corrosion prevention system. The ceramic conductor is received within a depression formed in a surface of the electrically insulative support member and the exposed surface of the ceramic conductor can be offset from or coplanar with an exposed surface of the electrically insulative support member. The ceramic conductor can comprise oxides of iridium, tantalum and titanium that are formed as a coating on a titanium substrate.

U.S. Pat. No. 8,118,983 discloses a corrosion inhibiting system, which is provided with the ability to allow both primary and secondary portions of the circuit to be used in the alternative without having the primary and secondary systems interfere with each other by operating at the same time. By incorporating a continuity controller, such as a switch or a diode to selectively disconnect the sacrificial anode from the circuit, the primary and secondary systems can both be provided on a marine vessel, but used independently from each other. In that way, the primary and secondary corrosion inhibiting systems are prevented from interfering with each other during normal operation.

U.S. Pat. No. 9,701,383 discloses a marine propulsion support system having a transom bracket, a swivel bracket, and a mounting bracket. A drive unit is connected to the mounting bracket by a plurality of vibration isolating mounts, which are configured to absorb loads on the drive unit that do not exceed a mount design threshold. A bump stop located between the swivel bracket and the drive unit limits deflection of the drive unit caused by loads that exceed the threshold. An outboard motor includes a transom bracket, a swivel bracket, a cradle, and a drive unit supported between first and second opposite arms of the cradle. First and second vibration isolating mounts connect the first and second cradle arms to the drive unit, respectively. An upper motion-limiting bump stop is located remotely from the vibration isolating mounts and between the swivel bracket and the drive unit.

U.S. Pat. No. 9,963,213 discloses a system for mounting an outboard motor propulsion unit to a marine vessel transom. The propulsion unit's midsection has an upper end supporting an engine system and a lower end carrying a gear housing. The mounting system includes a support cradle having a head section coupled to a transom bracket, an upper structural support section extending aftward from the head section and along opposite port and starboard sides of the midsection, and a lower structural support section suspended from the upper structural support section and situated on the port and starboard sides of the midsection. A pair of upper mounts couples the upper structural support section to the midsection proximate the engine system. A pair of lower mounts couples the lower structural support section to the midsection proximate the gear housing. At least one of the upper and lower structural support sections comprises an extrusion or a casting.

U.S. patent application Ser. No. 17/469,479 discloses a propulsion device for rotating a propulsor to propel a marine vessel. The propulsion device includes a drive housing having a cavity that extends along a first central axis. A motor is positioned within the cavity. The motor rotates a shaft extending along a second central axis that is non-coaxial with the first central axis. The shaft is configured to rotate the propulsor to propel the marine vessel.

U.S. patent application Ser. No. 17/487,116 discloses an outboard motor having a transom clamp bracket configured to be supported on a transom of a marine vessel and a swivel bracket configured to be supported by the transom clamp bracket. A propulsion unit is supported by the swivel bracket, the propulsion unit comprising a head unit, a midsection below the head unit, and a lower unit below the midsection. The head unit, midsection, and lower unit are generally vertically aligned with one another when the outboard motor is in a neutral tilt/trim position. The propulsion unit is detachable from the transom clamp bracket.

U.S. patent application Ser. No. 17/509,739 discloses an apparatus for removably supporting a marine drive on a marine vessel. The apparatus has a transom bracket assembly for mounting to the marine vessel, a steering bracket for coupling the marine drive to the transom bracket assembly so the marine drive is steerable relative to the transom bracket assembly and the marine vessel, and an integrated copilot and locking mechanism configured to retain the steering bracket in a plurality of steering orientations. The mechanism is further configured to lock and alternately unlock the steering bracket relative to the transom bracket assembly so that in a locked position the marine drive is retained on the transom bracket assembly and so that in an unlocked position the marine drive is removable from the transom bracket assembly.

U.S. patent application Ser. No. 17/550,463 discloses a marine drive having a supporting frame for coupling the marine drive to a marine vessel, a gearcase supporting a propulsor for propelling the marine vessel in water, an extension leg disposed between the supporting frame and the gearcase, and an adapter plate between the supporting frame and the extension leg. A tube is in the extension leg. The tube has a lower end which is coupled to the gearcase and upper end which is coupled to the adapter plate by a compression nut threaded onto the tube, wherein threading the compression nut down on the tube compressively engages the compression nut with the adapter plate, which in turn clamps the extension leg between the supporting frame and the gearcase.

U.S. patent application Ser. No. 17/554,540 discloses an outboard motor having a cowling, a gearcase, a midsection located axially between the cowling and the gearcase, a steering arm extending forwardly from the midsection, and an anti-ventilation plate between the midsection and the gearcase. A wing extends laterally from the steering arm. The wing, a lateral side of the cowling, and a lateral side of the gearcase together define a side tripod which supports the outboard motor in a side laydown position. The anti-ventilation plate has a rear edge with laterally outer rear support members, which together with the rear of the cowling form a rear tripod which supports the outboard motor in a rear laydown position.

U.S. patent application Ser. No. 17/585,214 discloses a marine drive for propelling a marine vessel. The marine drive has a propulsor configured to generate a thrust force in a body of water; a battery that powers the propulsor; and a supporting frame which supports the marine drive relative to marine vessel. The supporting frame has a monolithic body defining a frame interior, and further has a support leg extending downwardly from the monolithic body and a steering arm extending forwardly from monolithic body. A cowling is fixed to the supporting frame via at least one hidden fastener that extends from the frame interior, through the supporting frame, and into engagement with the cowl body, wherein hidden fastener being accessible during installation.

U.S. patent application Ser. No. 17/671,041 discloses a marine drive for propelling a marine vessel in a body of water. The marine drive comprises a gearcase defining a motor cavity; a motor disposed in the motor cavity; a propulsor shaft extending from the gearcase, wherein the motor is configured to cause rotation of the propulsor shaft; a propulsor which is rotated by the propulsor shaft to create a thrust force in the body of water; and a vent conduit having a first end connected to the motor cavity and a second end which vents the motor cavity to atmosphere.

SUMMARY

This Summary is provided to introduce a selection of concepts which are further described below in the Detailed Description. This Summary is not intended to identify key or essential features of the claimed subject matter, nor is it intended to be used as an aid in limiting the scope of the claimed subject matter.

In non-limiting examples disclosed herein, a marine drive is for propelling a marine vessel in a body of water and may include a frame configured to support the marine drive with respect to the marine vessel. A propulsor housing may be coupled to the frame, and the propulsor housing may be configured to support a propulsor for generating a propulsive force in the body of water. A vibration dampening joint may couple the propulsor housing to the frame or an extension thereof. The vibration dampening joint may comprise an isolator connector assembly having an elastomeric member which is clamped between the propulsor housing and the frame or the extension thereof such that all vibrations emanating from the propulsor housing pass through the elastomeric member prior to being transferred to the frame or the extension thereof. The marine drive may include a power source for providing electricity, and an electric circuit having a first end coupled to the power source and an opposite, second end coupled to the propulsor housing. The electric circuit may be configured to convey electricity from the power source to the propulsor housing and thus prevent fouling thereof, and the electric circuit may extend through the vibration dampening joint.

In examples disclosed herein, a system for antifouling of a marine drive that has a frame coupled to a propulsor housing may include a vibration dampening joint which couples the propulsor housing to the frame or an extension thereof. The vibration dampening joint may include an isolator connector assembly having an elastomeric member which is clamped between the propulsor housing and the frame or the extension thereof such that all vibrations emanating from the propulsor housing pass through the elastomeric member prior to being transferred to the frame or the extension thereof. A power source for providing electricity may be supported on the frame, and an electric circuit may have a first end coupled to the power source and an opposite, second end coupled to the propulsor housing. The electric circuit may be configured to convey electricity from the power source to the propulsor housing and thus prevent fouling thereof, and the electric circuit may extend through the vibration dampening joint.

In examples disclosed herein, a compression limiting joint for coupling a frame of a marine drive to a propulsor housing of the marine drive may include an isolating connector assembly. The isolating connector assembly may include an elastomeric member, a compression limiter, and an electric circuit. The elastomeric member may be clamped between the frame and the propulsor housing and configured to limit transfer of vibrations from the propulsor housing to the frame. The compression limiter may be configured to prevent over clamping of the elastomeric member during assembly of the frame and the propulsor housing. The electric circuit may be configured to provide a conductive path between a power source on the frame and the propulsor housing. The electric circuit may extend through the elastomeric member from a first end in electrical communication with a first one of the frame and the propulsor housing to a second end in electrical communication with a second one of the frame and the propulsor housing.

BRIEF DESCRIPTION OF THE DRAWINGS

The present disclosure includes the following Figures.

DETAILED DESCRIPTION

The invention described herein below has been found to be particularly useful in configurations of marine drives having an electric motor located in a lower gearcase and being configured to power a propulsor, such as one or more propeller(s), impeller(s), and/or the like. The illustrated embodiment is just one example of such a marine drive, however the present invention is not limited for use with the illustrated configuration, and in other examples the present invention can be implemented in differently configured marine drives, for example having an internal combustion engine, a hybrid-electric powerhead, and/or the like. The configurations of the marine drive shown and described herein below, including the supporting frame, electric motor, and gearcase, are merely exemplary. The present invention is also useful in conjunction with many other marine drive configurations.

During research and development in the field of marine drives, the present inventors determined that electric motors can be rich in harmonic content, and the noise generated is very tonal and prominent. This may result in poor sound quality, which users may consider annoying or irritating and can present as an unrefined product. The vibrations created by electric motors in existing marine propulsion devices can travel up through the various structures and joints of the propulsion device with minimal resistance. Through their research and experimentation, the inventors determined that it would be advantageous to provide vibration isolating (i.e. dampening) features that isolate the motor from other portions of the marine drive.

The present inventors further determined through research and experimentation that anodic corrosion protection systems require continuity on all major parts containing ample surface area to best protect the marine drive. However, embodiments of vibration dampening features can create a break in the continuity path, resulting in an open circuit. In order to maintain sufficient anodic protection, embodiments of marine drives have included a 'ground strap' or wire that links portions of the marine drive to close the circuit around the isolation elements. However, use of a ground strap may be undesirable as it can complicate manufacturing and assembly methods, affect the styling of the marine drive, and can otherwise be inconvenient for a number of reasons. Through their research and experimentation, the inventors determined that it would be advantageous to provide an anti-fouling system that includes a vibration dampening joint that does not electrically disconnect portions of the marine drive housing. The present disclosure is a result of the present inventors' efforts in this regard.

Figure 1:
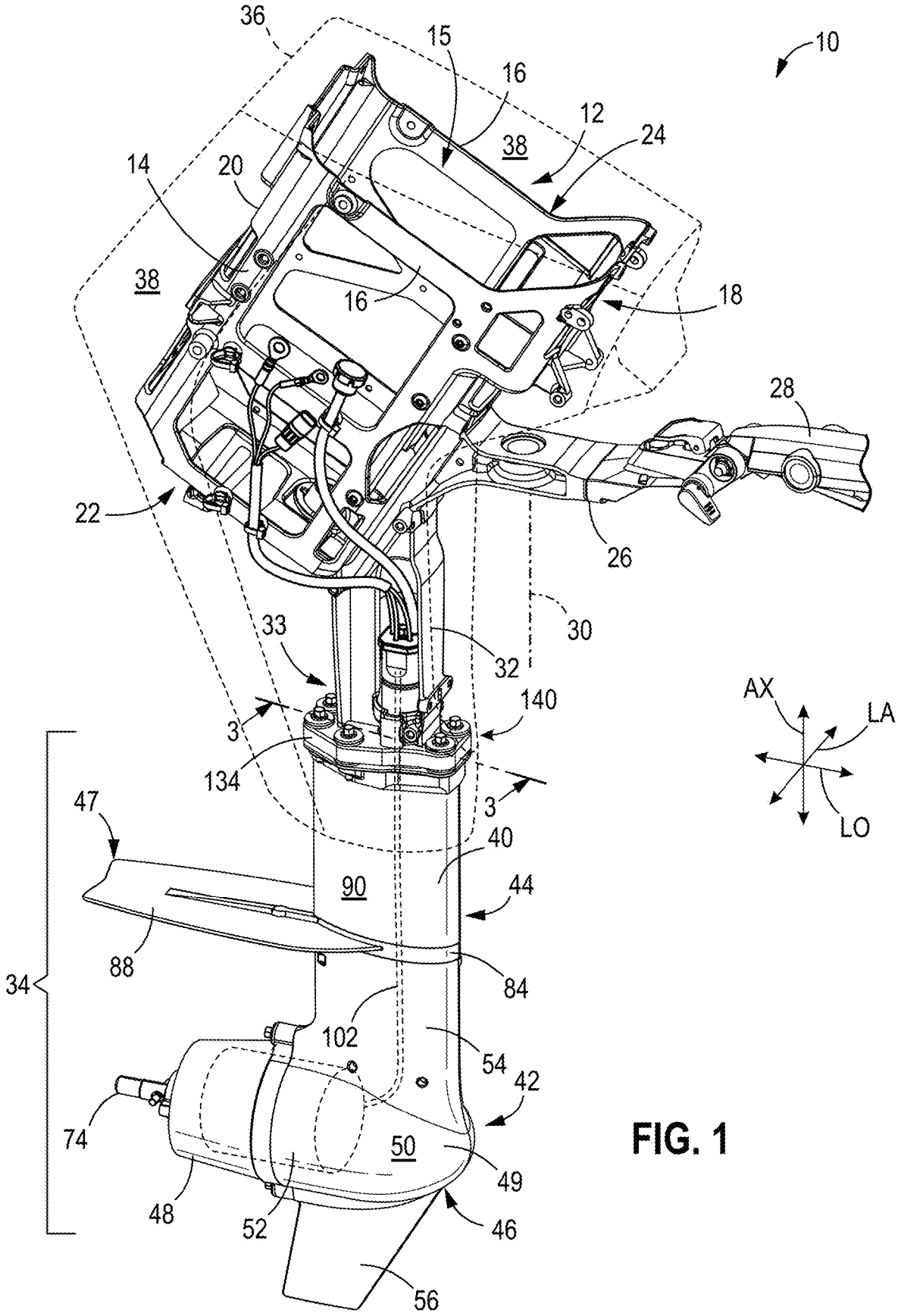
FIG. 1 is a side perspective view of a first embodiment of a marine drive for propelling a marine vessel in water according to the present disclosure.

FIG. 1 depicts a marine drive 10 for propelling a marine vessel in a body of water. In the illustrated embodiment, the marine drive 10 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO. FIG. 1 only depicts certain portions of the marine drive 10. Although not shown, the marine drive 10 is attachable to the marine vessel via, for example, a conventional transom bracket and/or the like. Other suitable arrangements are provided in the above-incorporated patents, and others are widely commercially available for purchase from Brunswick Corporation and its companies Attwood and Mercury Marine, among others.

The marine drive 10 is an outboard motor having a supporting frame 12 for rigidly supporting the various components of the marine drive 10 with respect to the marine vessel. The supporting frame 12 has a generally rectangular, box-shaped body 14 with port and starboard sides 16, a front side 18, a rear side 20, a bottom 22, and an open upper end 24 providing access to a frame interior 15 for containing a rechargeable battery (not shown) providing battery power to the marine drive 10. The supporting frame 12 also has a steering arm 26 extending forwardly from the front side 18 of the body 14. The steering arm 26 is configured for connection to a tiller arm 28 for manually steering the marine drive 10 relative to the marine vessel about a steering axis 30, which is defined by the above-noted transom bracket. See, for example, the presently-incorporated U.S. patent application Ser. No. 17/509,739.

A cowling, shown schematically at 36, is fixed to and surrounds most or all of the body 14 of the supporting frame 12, as further disclosed in the above-incorporated U.S. patent application Ser. No. 17/585,214. The cowling 36 defines a cowling interior 38 in which the body 14 of the supporting frame 12 and various components of the marine drive 10 are disposed. It should be understood that the various components described above are exemplary and could vary from what is shown. For example, the present invention is not limited for use with the particular type of supporting frame shown in the figures. The supporting frame can be any type of supporting frame known in the art for framing and supporting portions of the marine drive, including being configured to support various components of the marine drive, and/or to couple the marine drive to the marine vessel. Embodiments of various other suitable supporting frames for marine drives are provided in the above-incorporated patents.

The supporting frame 12 has a support leg 32 extending downwardly from the bottom 22 of the body 14 and having a lower end 33 that is coupled to the lower unit 34 of the marine drive 10 by a novel vibration isolating joint 140. The lower unit 34 generally includes a propulsor housing 42, an extension leg 44, and an anti-ventilation plate 47 disposed between the propulsor housing 42 and the extension leg 44. The extension leg 44 depends on the supporting frame 12, and the propulsor housing 42 depends on the extension leg 44. The propulsor housing 42 has a front housing portion 46 and a rear housing portion 48 that are mated together and define a motor cavity for containing an electric motor 52 and related componentry, which otherwise defines a generally open space that is devoid of fluid. The front housing portion 46 has a nosecone 49 with a smooth outer surface which transitions to an upwardly extending stem 54 and a downwardly extending skeg 56.

The electric motor 52 causes rotation of a propulsor shaft 74 which longitudinally extends from the rear of the rear housing portion 48. The electric motor 52 is a conventional item, for example an axial flux motor, a radial flux motor, or a transverse flux motor, such as those produced by Electric Torque Machines of Flagstaff, Arizona (a Graco Company). Front and rear bearings support and facilitate rotation of the propulsor shaft 74 relative to the electric motor 52. A conventional propulsor (not shown), is mounted on the outer end of the propulsor shaft 74 such that rotation of the propulsor shaft 74 by the electric motor 52 causes rotation of the propulsor, which in turn generates a thrust force for propelling the marine vessel in water. The type and configuration of the propulsor can vary, and for example can include one or more propellers, impellers, and/or the like.

With continued reference to FIG. 1, the anti-ventilation plate 47 has a head 84 at its forward end which is sandwiched between the lower end of the extension leg 44 and the stem 54 of the front housing portion 46. The head 84 has a perimeter sidewall with a rounded forward end and a tapered rear end. The perimeter sidewall is preferably monolithic so as to avoid external fasteners or other unsightly seams. In other examples it can be made of multiple pieces. The radially outer profile of the head 84 generally matches the radially outer profile of the lower end of the extension leg 44 and the radially outer profile of the upper end of the stem 54, in particular such that these components together provide a smooth outer surface which is streamlined and encounters minimal hydrodynamic drag as the marine vessel travels through the water. The anti-ventilation plate 47 has a generally flat tail 88 which extends rearwardly from both sides of the head 84.

The extension leg 44 includes an elongated body 40 having a perimeter sidewall 90 which defines a hollow interior 92. The elongated body 40 is preferably monolithic to as to avoid externally visible fasteners or unsightly seam lines. In other embodiments it can be formed from multiple pieces. A rigid conduit portion or tube 94 is located in the hollow interior 92. The tube 94 is generally impervious to fluids and has a hollow interior, a lower end which is fixedly coupled to the propulsor housing 42 and an upper end 98 which is coupled to the supporting frame 12 via a compression nut 100, as further described herein below. In the non-limiting illustrated embodiments, the tube 94 is a monolithic aluminum tube. The hollow interior of the tube provides a passageway for among other things, a wiring harness comprising electrical wires 102 extending from an upper portion of the marine drive 10 to the motor cavity 50, and for connection to the electric motor 52, i.e., for providing electricity to the electric motor 52 and/or for controlling the electric motor 52.

Figure 2:
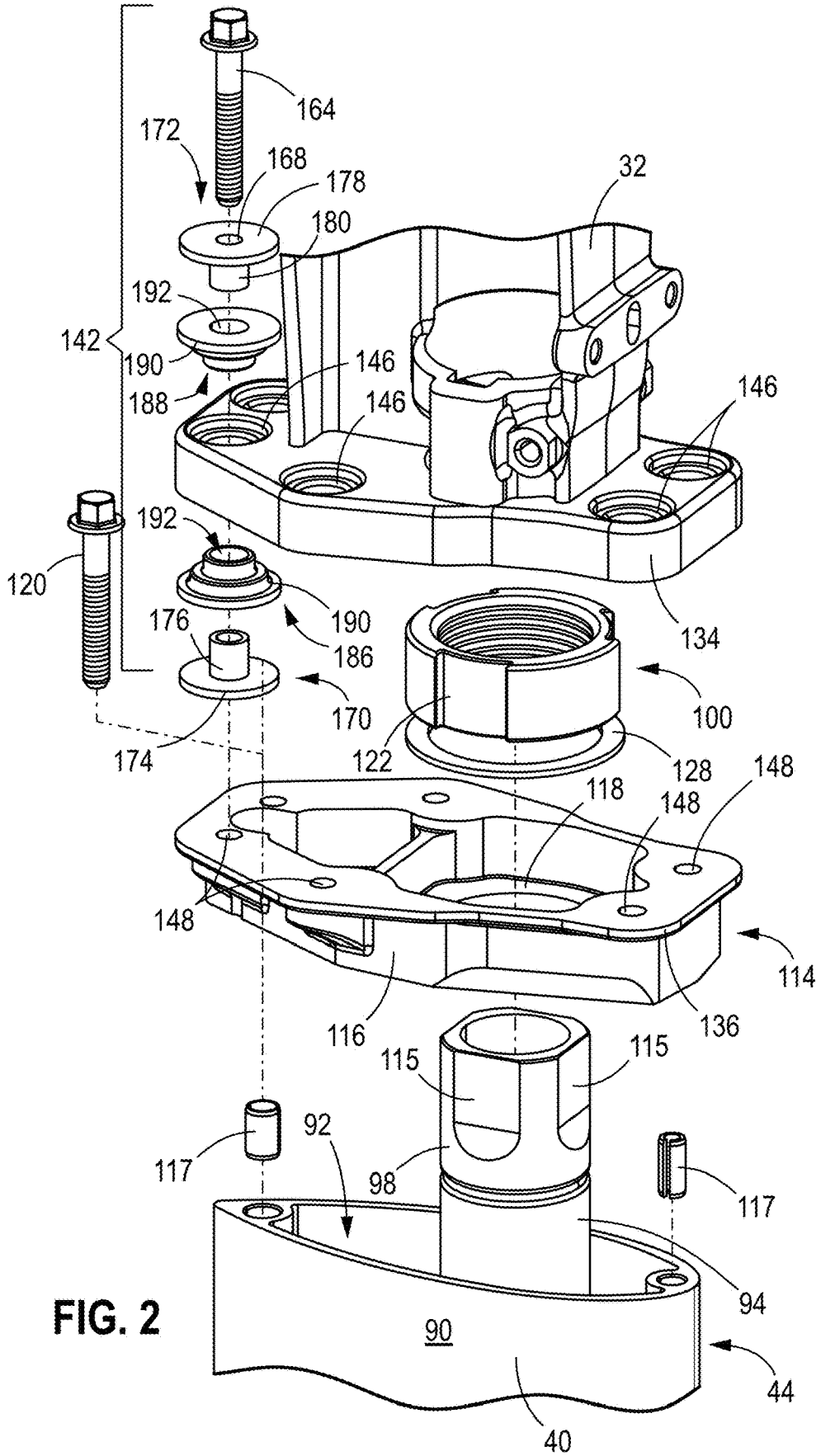
FIG. 2 is an exploded view showing portions of a supporting frame configured to support the marine drive with respect to the marine vessel, an extension leg depending on the supporting frame, and a vibration isolating joint which couples the extension leg to the supporting frame.
Figure 3:
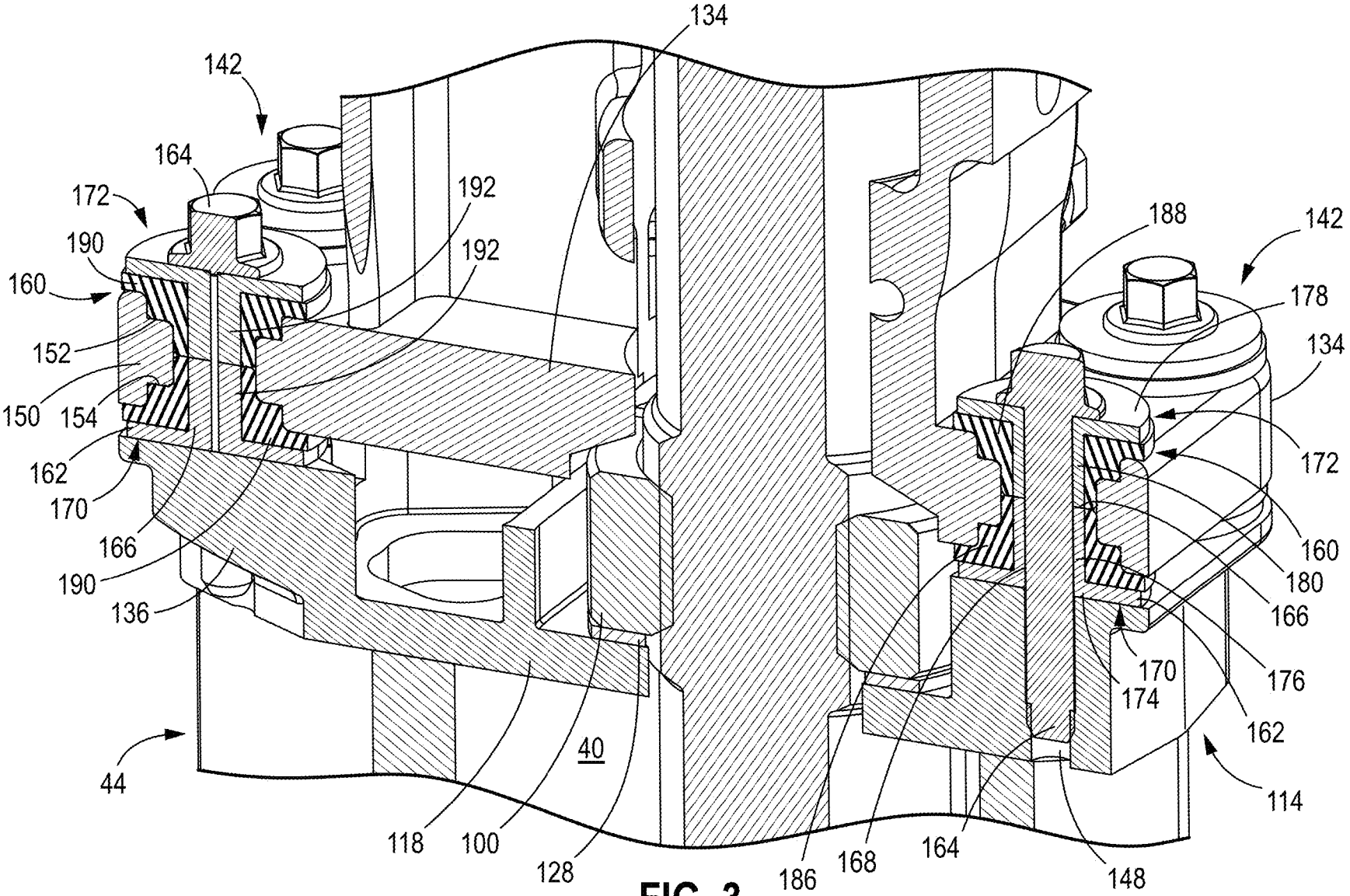
FIG. 3 is a view of Section 3-3, taken in FIG. 1.

Referring to FIGS. 2 and 3, the extension leg 44 includes an adapter plate 114 which is fastened to the upper end of the elongated body 40. The adapter plate 114 has a perimeter sidewall 116 and an interior abutment surface 118 which laterally and longitudinally extends between the tube 94 and the inner diameter of the perimeter sidewall 116 of the adapter plate 114. The interior abutment surface 118 extends entirely around the tube 94. As best seen in FIGS. 1 and 2, the upper end 98 of the tube 94 axially extends out of the hollow interior 92 of the extension leg 44, through a hole in the interior abutment surface 118, and protrudes into an interior passage of the supporting frame 12. The adapter plate 114 includes leg mounting flange 136 which extends from and around the perimeter of the perimeter sidewall 116 at a top side of the adapter plate 114. Pins 117 register and maintain the adapter plate 114 in alignment with extension leg 44. The pins 117 extend into bores formed in the perimeter sidewall 116 of the adapter plate 114 and into corresponding bores formed in the perimeter sidewall 90 of the upper end of the extension leg 44. Additionally or alternatively, a fastener 120 may extend through at least one set of said corresponding bores to fasten the adapter plate 114 to the elongated body 40.

The compression nut 100 is engaged with the upper end 98 of the tube 94 via a threaded connection, and particularly so as to clamp the extension leg 44 in place between the adapter plate 114 and the propulsor housing 42, thereby providing increased overall load carrying capability compared to the prior art and advantageously avoiding the use of fasteners which are visible from the exterior of the lower unit 34. As best seen in FIG. 2, the inner diameter of the compression nut 100 has threads for engaging corresponding threads on the upper end 98 of the tube 94. Flats 122 are disposed around the outer perimeter of the compression nut 100 for engagement by a manual tool for rotating the compression nut 100 about the tube 94.

To assemble the lower unit, a washer 128 and the compression nut 100 are slid onto the upper end 98 of the tube 94 until the threads abut. The compression nut 100 is then rotated by a wrench in a direction which causes the compression nut 100 to travel downwardly along the tube 94, via engagement between the threads. Continued rotation of the compression nut 100 moves it into compressing engagement with the top of the interior abutment surface 118. Compression of the compression nut 100 applies a corresponding clamping force on the adapter plate 114, which pulls the tube 94 and propulsor housing 42 axially upwardly. This firmly compresses and clamps the head 84 of the anti-ventilation plate 47 and the extension leg 44 between the propulsor housing 42 and bottom of the adapter plate 114 without the need for external fasteners and in an improved load-bearing arrangement. Advantageously the entire arrangement can be easily assembled in an efficient manner and with minimal externally visible fasteners.

Referring to FIGS. 2 and 3, the lower end of the supporting frame 12 has a frame mounting flange 134 which extends from and around the perimeter of the support leg 32 at a bottom end of the support leg 32. The extension leg 44 includes a leg mounting flange 136 positioned at the upper end thereof. As previously discussed, the leg mounting flange 136 is included on the adapter plate 114 in the illustrated embodiments. Other embodiments, however, may include an extension leg with an integrally formed leg mounting flange. A radially outer profile of the leg mounting flange 136 generally matches the radially outer profile of the frame mounting flange 134. A plurality of bores 146 are formed through the frame mounting flange 134, and each bore 146 in the frame mounting flange 134 is arranged in vertical axial alignment with a corresponding bore 148 formed through the leg mounting flange 136. In the non-limiting illustrated embodiments, the bores 146 in the frame mounting flange 134 are configured as double counterbored holes 146. That is, the bores 146 in the frame mounting flange 134 are counterbored from both sides so that an annular ring 150 having an upper surface 152 and a lower surface 154 is formed around the interior diameter of the bores 146 (see, e.g., FIG. 5). In other embodiments, at least one of the bores 148 formed through the leg mounting flange 136 may be configured as a counterbored hole, and/or at least one bore 146 in the frame mounting flange 134 may not be a counterbored hole.

As is described in further detail herein below, the novel anti-fouling system for a marine drive includes a vibration isolating joint 140, the battery or other power source (not shown) mounted within the frame interior 15, and an electric circuit 210 which extends through the vibration dampening joint 140 and provides a conductive path between the power source and the propulsor housing 42.

The vibration isolating joint 140 couples the frame mounting flange 134 and the leg mounting flange 136, thereby coupling the extension leg 44 to the supporting frame 12. The vibration isolating joint 140 includes a plurality of isolating connector assemblies 142 spaced apart around the frame mounting flange 134 and the leg mounting flange 136. Each isolating connector assembly 142 engages one of the counterbored holes 146 in the frame mounting flange 134 and the corresponding one of the bores 148 in the leg mounting flange 136. In the non-limiting embodiment, the vibration isolating joint 140 includes six isolating connector assemblies 142. Other embodiments may include a different number of isolating connector assemblies 142, and/or at least one isolating connector assembly 142 may be arranged in a different position than those of the illustrated embodiments.

Referring to FIGS. 2 and 3, each isolating connector assembly 142 includes an elastomeric member 160, a compression limiter 162, and a fastener 164. The fastener 164 extends through the elastomeric member 160 and the compression limiter 162 and couples the frame mounting flange 134 and the leg mounting flange 136 together. The compression limiters 162 are rigid members having a rigid cylinder 166 with a bore 168 through which the fastener 164 extends. In the non-limiting illustrated embodiments, the compression limiters 162 include a first limiter portion 170 and a second limiter portion 172. The first limiter portion 170 includes a first annular flange 174 and a first cylinder half 176 and is located between the leg mounting flange 136 of the extension leg 44 and the frame mounting flange 134 of the supporting frame 12. The second limiter portion 172 includes a second annular flange 178 and a second cylinder half 180 and is located on an opposite side of the leg mounting flange 136 of the extension leg 44. The first limiter portion 170 and the second limiter portion 172 oppose each other such that the first and second cylinder halves 176, 180 abut each other to form the rigid cylinder 166. Together, the first limiter portion 170 and second limiter portion 172 define an axial space 182 between the first and second annular flanges 174, 178 in which elastomeric member 160 is located, as illustrated in FIG. 3.

The elastomeric member 160 has a first resilient portion 186 located between the leg mounting flange 136 and the frame mounting flange 134 and a second resilient portion 188 located on an opposite side of the frame mounting flange 134 relative to the first resilient portion 186. The first resilient portions 186 and the second resilient portions 188 are configured to be received in the counterbored holes 146. Referring to FIG. 3, an annular flange 190 of the first resilient portion 186 abuts the lower surface 154 of the annular ring 150 and an annular flange 190 of the second resilient portion 188 abuts the upper surface 152 of the annular ring 150. The first and second resilient portions 186, 188 each include a bore 192 configured to respectively receive the first and second cylinder halves 176, 180 of the first and second limiter portions 170, 172. When assembled, the first resilient portion 186 is located between the first limiter portion 170 and the frame mounting flange 134 of the supporting frame 12 and the second resilient portion 188 is located between the second limiter portion 172 and the frame mounting flange 134 of the supporting frame 12. Thus, the elastomeric member 160 is clamped in the axial space 182 between first annular flange 174 and the second annular flange 178.

As previously mentioned, embodiments of an anti-fouling system may include an electric circuit which extends through the vibration dampening joint 140. For example, the electric circuit may include a conductive material disposed on at least a portion of the surface of at least one of the resilient portions 186, 188 of an elastomeric member 160 to create a conductive path between the compression limiter 162 and the frame mounting flange 134. Other embodiments may include an electric circuit which extends through the elastomeric member. For example, referring to FIGS. 4-17, an isolating connector assembly 142 may include an electric circuit 210 extending through the elastomeric member 160, and particularly at least one of the resilient portions 186, 188 thereof. In each of the illustrated embodiments, the electric circuit 210 has a first end 212 in electrical communication with the power source and a second end 214 in electrical communication with the propulsor housing 42. Thus, the electric circuit 210 provides a conductive path that conveys electricity from the power source on the supporting frame 12 to the propulsor housing 42 in order to prevent fouling of the propulsor housing 42.

Figure 4:
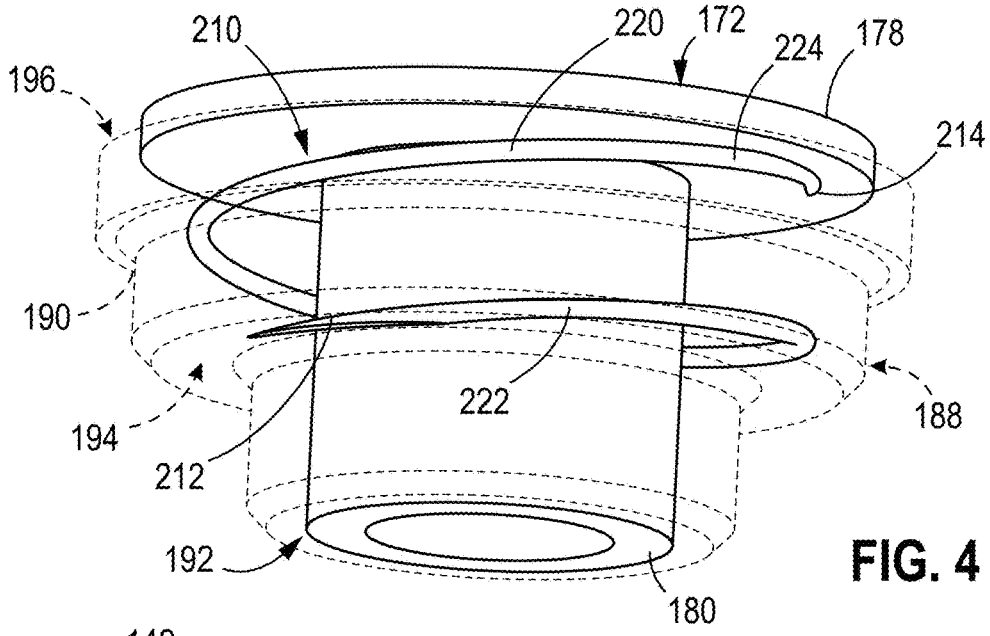
FIG. 4 is a perspective view of an embodiment of an elastomeric member with an electric circuit.

Referring to FIG. 4, the illustrated embodiment of the electric circuit 210 includes a coil spring 220 extending through one of the resilient portions 188 of an elastomeric member. The coil spring 220 is positioned within the annular flange 190 of the resilient portion, 188 and extends circumferentially around the bore 192. A first end 222 of the coil spring 220 is positioned at a first flange surface 194 of the annular flange 190, and a second end 224 of the coil spring 220 is positioned at a second flange surface 196 opposite the first flange surface 194. In FIG. 4, the resilient portion is oriented such that the first flange surface 194 is a lower, downwardly facing surface and the second flange surface 196 is an upper, upwardly facing surface. However, it should be appreciated that the resilient portions 186, 188 of the elastomeric member 160 are interchangeable and the orientation of the resilient portions 186, 188 may be reversed.

Figure 5:
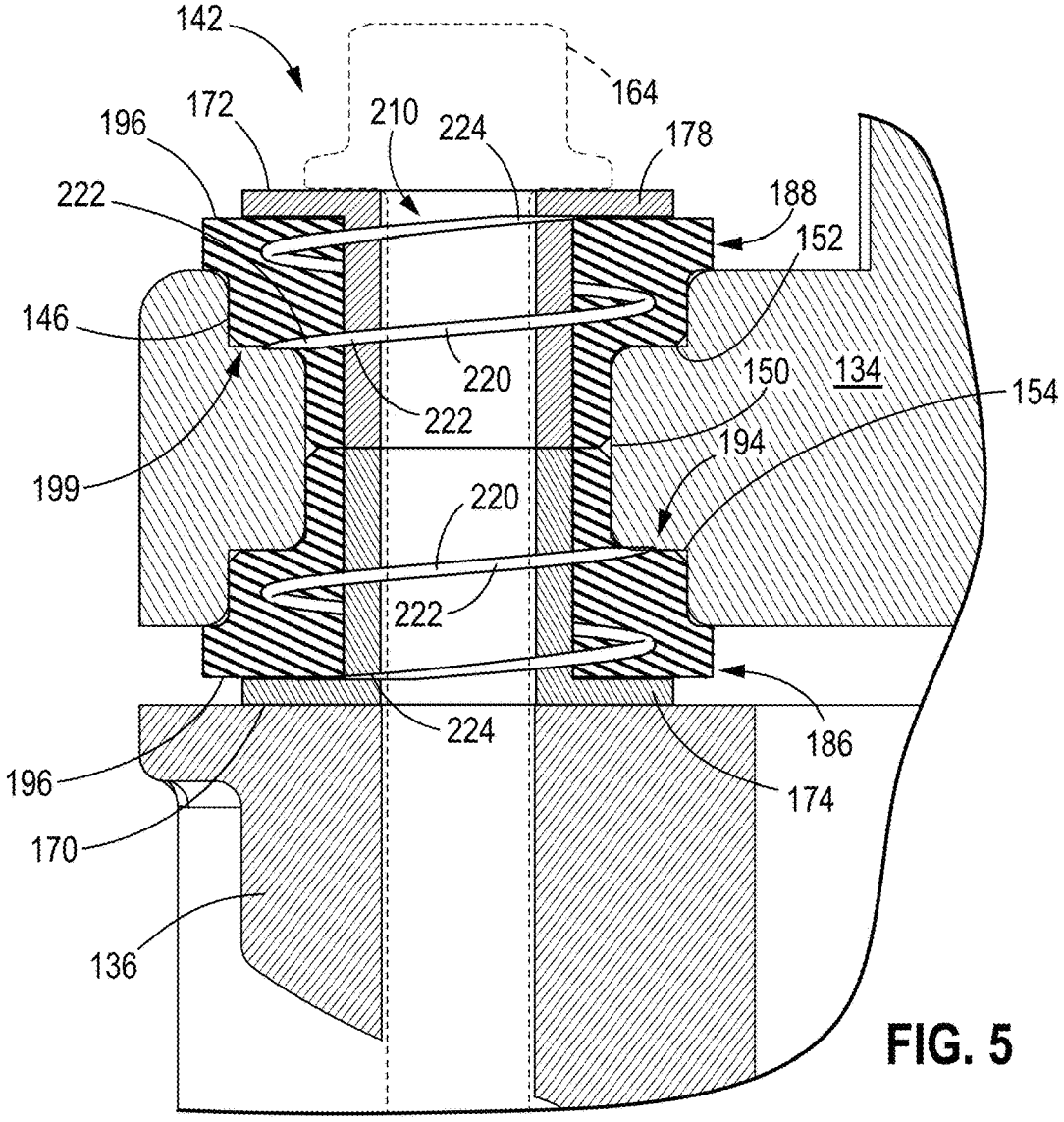
FIG. 5 is a closer view of a portion of Section 3-3 with the elastomeric member of FIG. 4.

Referring to FIG. 5, which depicts an assembled isolating connector assembly 142, the resilient portions 186, 188 are received in the counterbored hole 146 in the frame mounting flange 134 such that the first end 222 of each coil spring 220 is connected to the frame mounting flange 134 and the second end 224 of each coil spring 220 is connected to a corresponding one of the first and second annular flanges 174, 178 of the compression limiter 162. Thus, the electric circuit 210 in each resilient portion 186, 188 extends from a first flange surface 194 of the annular flange 190, which is in contact with the support leg 32 of the supporting frame 12, to a second flange surface 196, which is in contact with either the first or second limiter portion 170, 172 of the compression limiter 162.

Figure 6:
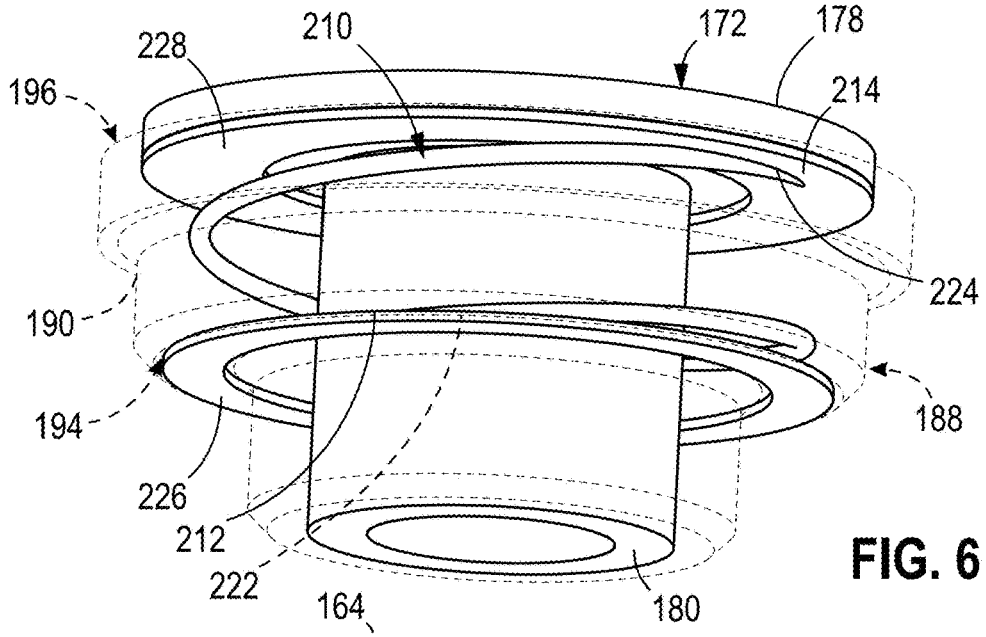
FIG. 6 is a perspective view of another embodiment of an elastomeric member with an electric circuit.

Some embodiments of an electric circuit may include a conductive contact surface for electrically connecting the electric circuit to at least one of the supporting frame and the propulsor housing. For example, as illustrated in FIGS. 6, at least one of the first and second ends 212, 214 of an electric circuit 210 may include conductive plates 226, 228 connected to the first and second ends 222, 224 of the coil spring 220. A first conductive plate 226 is positioned on the first flange surface 194 and is configured as a generally planar annular ring that extends around the cylindrical portion of the resilient portion 188, and a second conductive plate 228 is positioned on the second flange surface 196 and is similarly configured as an annular ring that extends around the bore 192 extending through said resilient portion.

Figure 7:
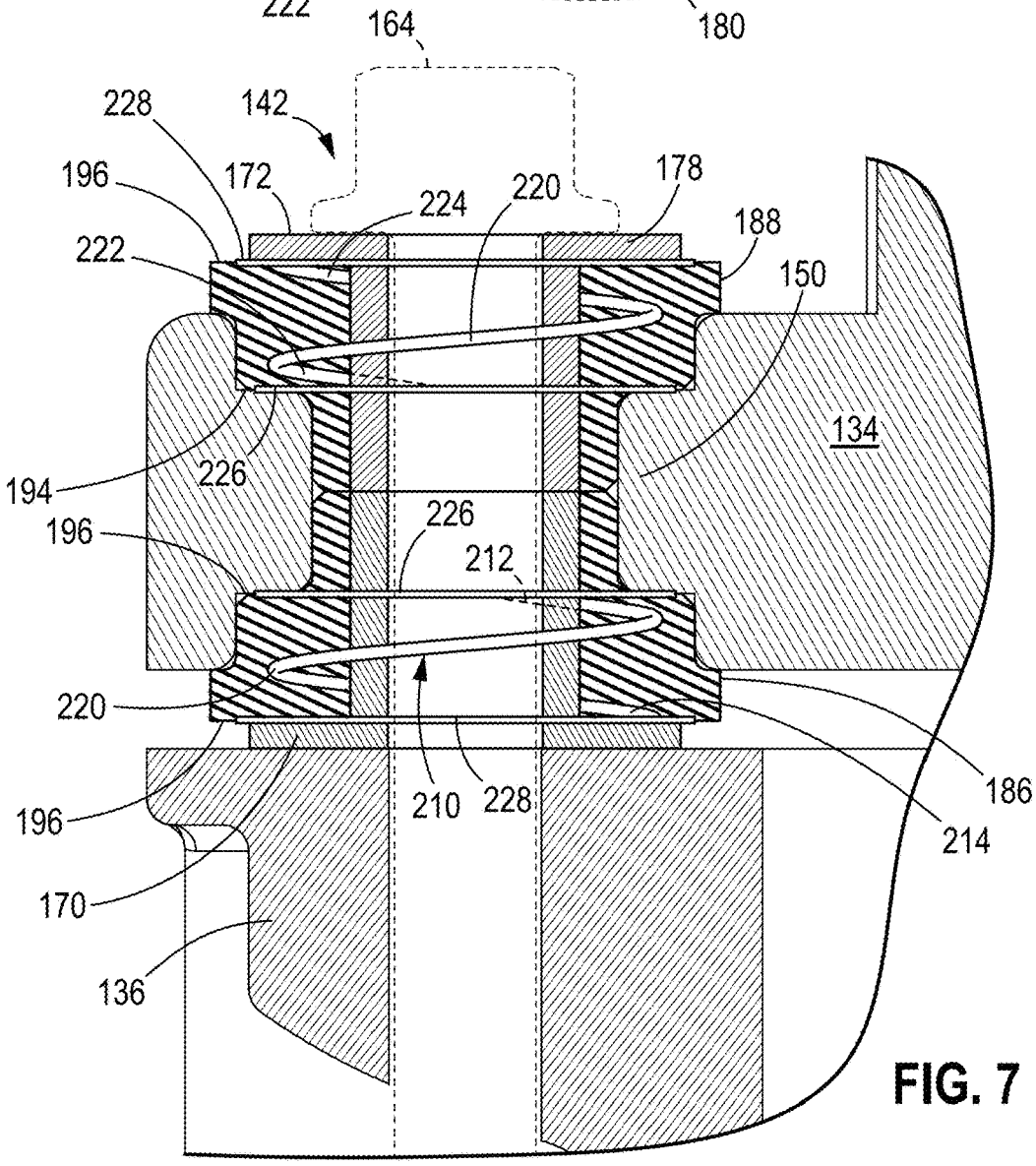
FIG. 7 is a closer view of a portion of Section 3-3 with the elastomeric member of FIG. 6.

Referring to FIG. 7, each of the first conductive plates 226 electrically connects the first end 212 of the electric circuit 210 to the frame mounting flange 134, each the second conductive plates 228 electrically connects the second end 214 of the electric circuit 210 to the compression limiter 162. In particular, the second conductive plate 228 of the first resilient portion 186 is positioned on a bottom surface of the elastomeric member 160, thereby connecting the electric circuit 210 to the propulsor housing via the first limiter portion 170, and the second conductive plate 228 of the second resilient portion 188 is positioned on a top surface of the elastomeric member 160, thereby connecting its electric circuit 210 to the propulsor housing 42 via the second limiter portion 172 and the first limiter portion 170. While the illustrated electric circuit 210 includes one conductive plate 226, 228 at each end 212, 214 of the electric circuit 210, it should be appreciated that some embodiments may include only one the conductive plate on either the first flange surface 194 or the second flange surface 196.

Figure 8:
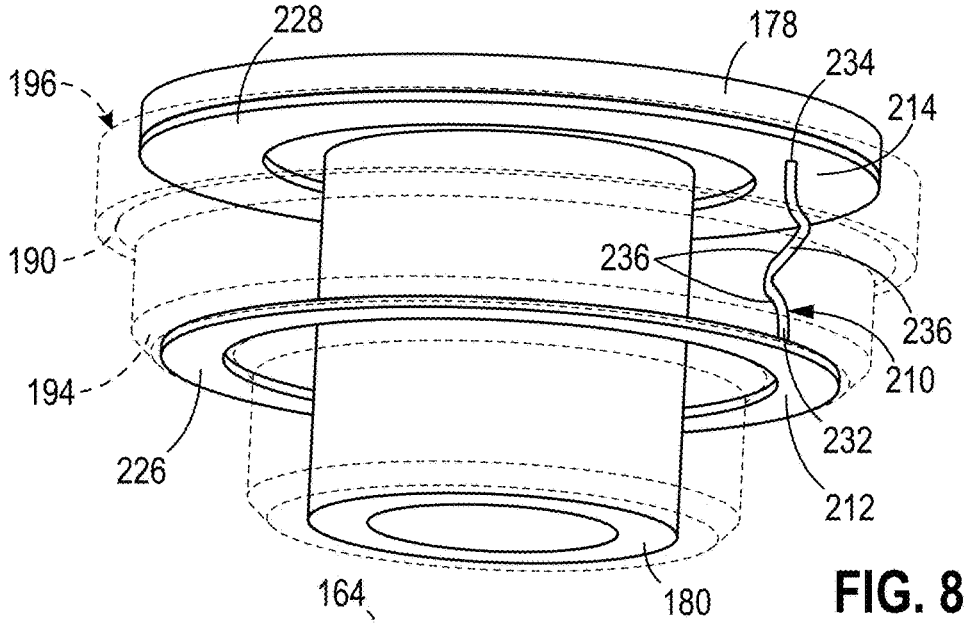
FIG. 8 is a perspective view of another embodiment of an elastomeric member with an electric circuit.
Figure 9:
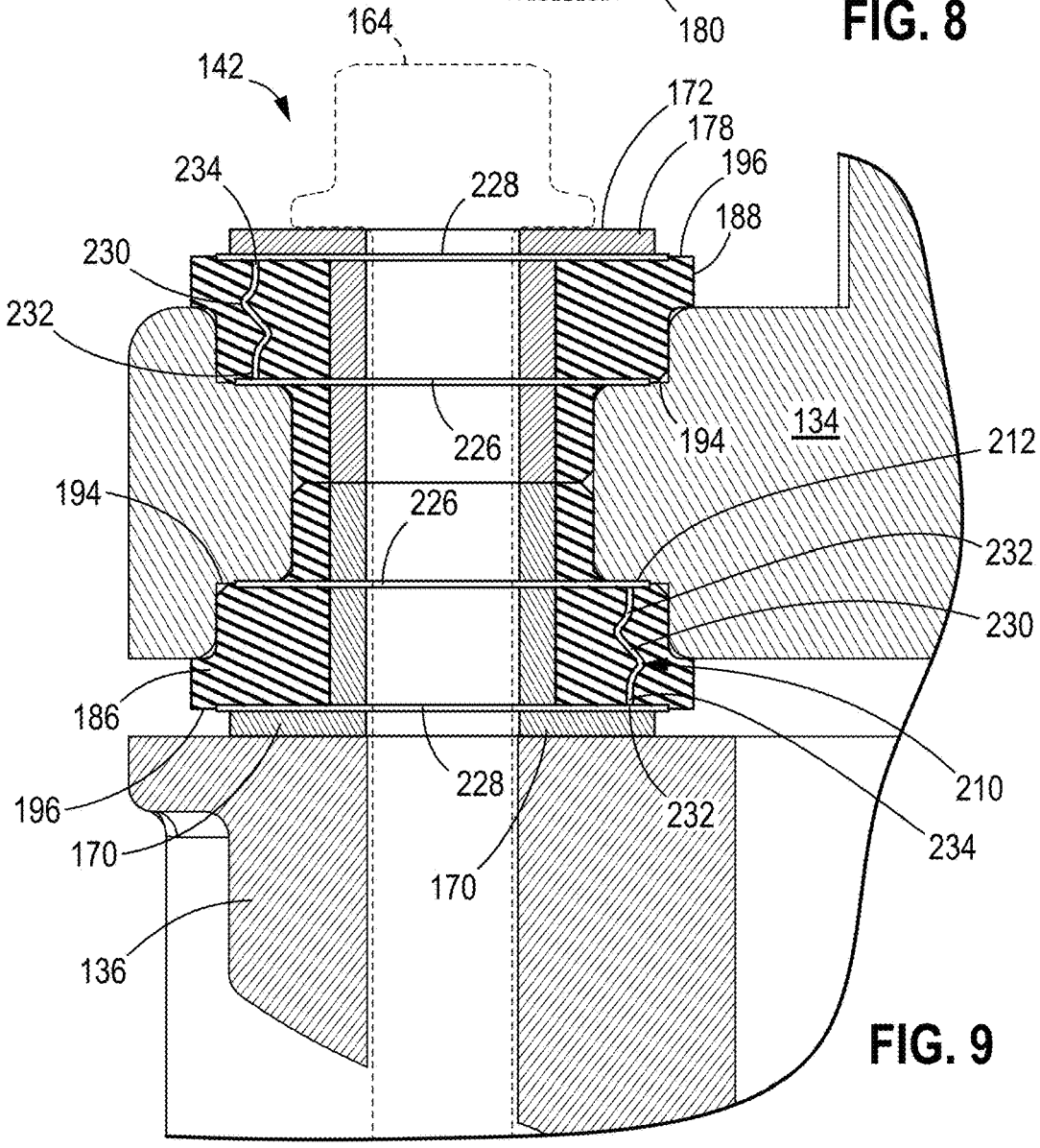
FIG. 9 is a closer view of a portion of Section 3-3 with the elastomeric member of FIG. 8.

While the electric circuits of FIGS. 4-7 each include a coil spring extending through the resilient portions 186, 188, some embodiments may include a differently configured electric circuit. FIGS. 8 and 9 illustrate an embodiment of an elastomeric member 160 with resilient portions 186, 188 having an electric circuit 210 that includes a conductive wire 230 configured as a spring member. The conductive wire 230 extends along a curved path through each of the resilient portions 186, 188 from a first end 232 that is connected to the first conductive plate 226 at the first flange surface 194 to a second end 234 connected to the second conductive plate 228 at the second flange surface 196. The bends 236 in the conductive wire 230 allow the electric circuit 210 to expand or contract without breaking or permanently deforming.

Figure 10:
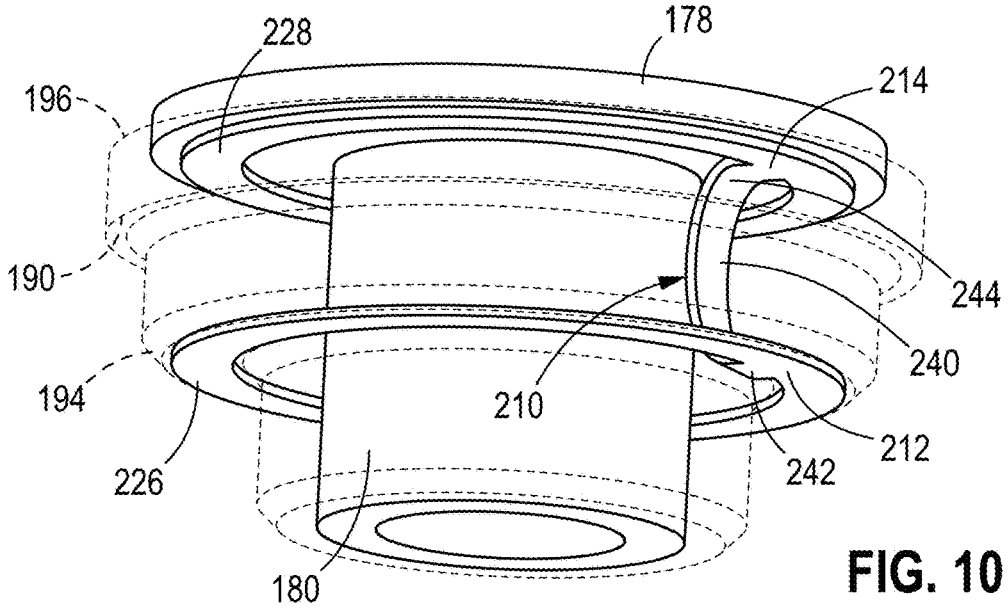
FIG. 10 is a perspective view of another embodiment of an elastomeric member with an electric circuit.
Figure 11:
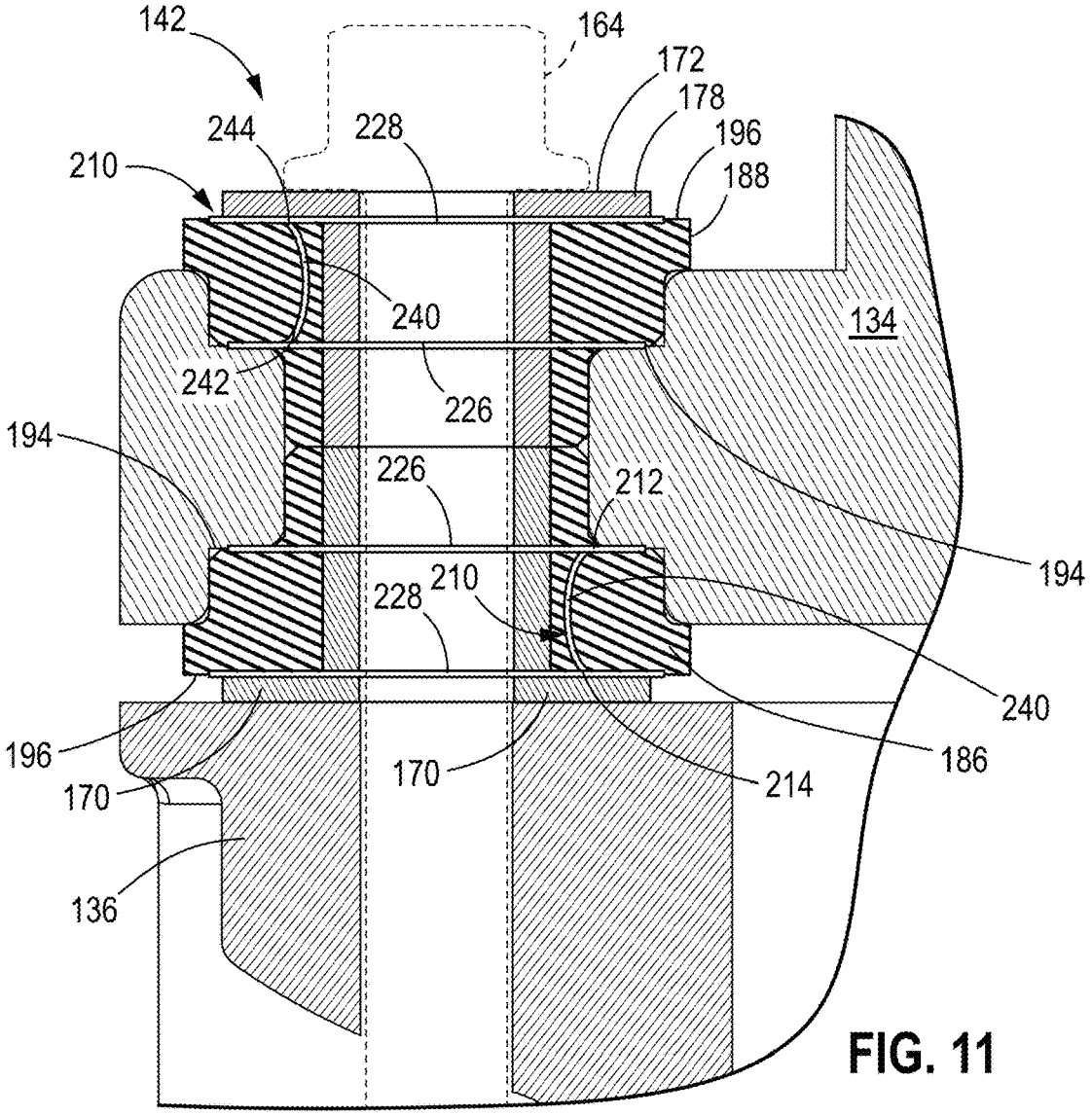
FIG. 11 is a closer view of a portion of Section 3-3 with the elastomeric member of FIG. 10.

Referring to FIGS. 10 and 11, the electric circuits 210 in each of the resilient portions 186, 188 includes conductive strip 240 extending in a curved path through the resilient portions 186, 188 of the vibration dampening joint 140. The curve in the conductive strip 240 allows the electric circuit 210 to be compressed without breaking. In the illustrated embodiment, the first conductive plate 226 is integrally formed with the first end 442 of the conductive strip 240 and the second conductive plate 228 is integrally formed with the second end 444 of the conductive strip 240. Other embodiments, however, may include a conductive strip with at least one end that is not integrally connected to a conductive plate.

Figure 12:
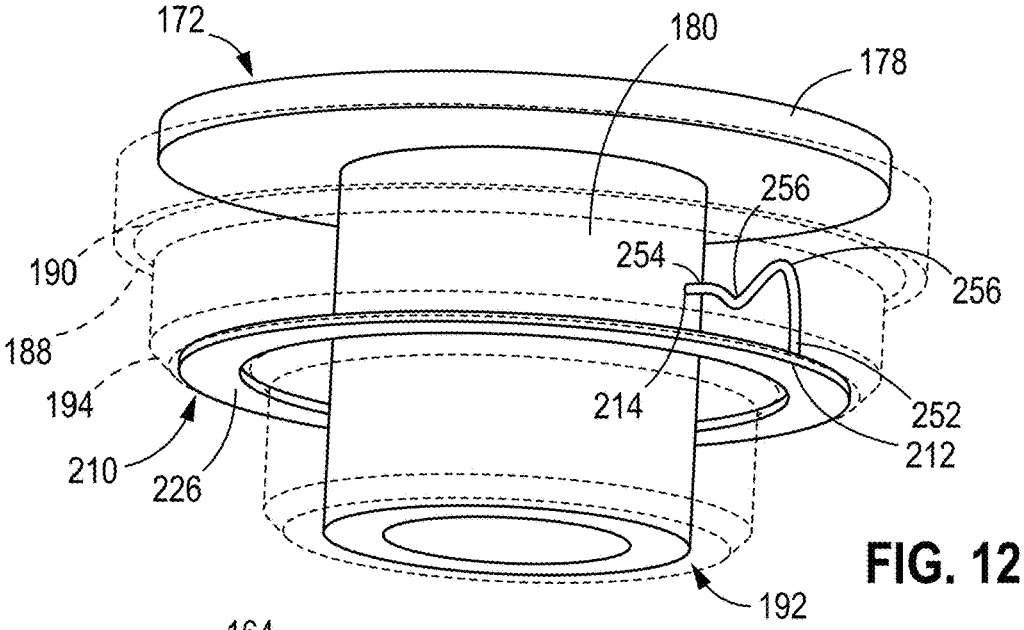
FIG. 12 is a perspective view of another embodiment of an elastomeric member with an electric circuit.

FIGS. 4-11 depict embodiments of an electric circuit 210 with a first end 212 positioned at the first flange surface 194 of an annular flange 190 and a second end 214 positioned at the second flange surface 194 of said annular flange 190. Some embodiments, however, may include and electric circuit that extends from the bore to a flange surface of at least one of the resilient portions 186, 188 of the elastomeric member 160. For example, FIG. 12 illustrates an embodiment of a resilient portion 188 with an electric circuit 210 that has a first end 212 at the first flange surface 194 of the annular flange 190 and a second end 214 positioned at the bore surface 198 of the bore 192. A conductive plate 226 is positioned at the first flange surface 194 and is connected to a first end 252 of a conductive wire 250. The conductive wire 250 extends through the resilient portion 188 along a curved path to a second end 254 that is exposed at the radially inner surface 198 of the resilient portion 188 formed by the bore 192 through the elastomeric member 160. The bends 256 in the conductive wire 250 allow the conductive wire 250 to deform without breaking such that the conductive wire 250 acts as a spring. Thus, the conductive wire 250 acts as a spring with a first end 252 at the first flange surface 194 and a second end 254 at a radially inner surface 198 of the elastomeric member 160.

Figure 13:
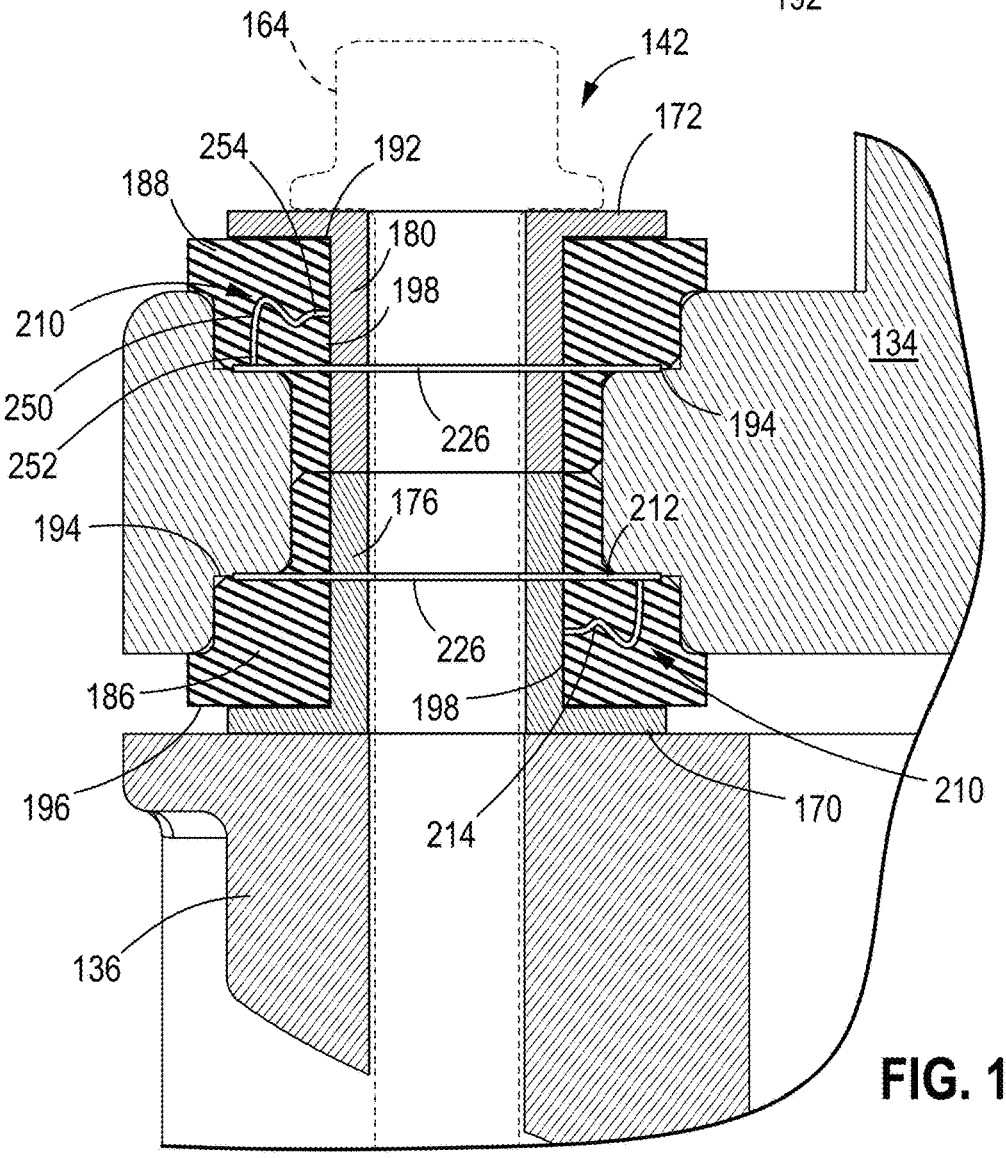
FIG. 13 is a closer view of a portion of Section 3-3 with the elastomeric member of FIG. 12.
Figure 14:
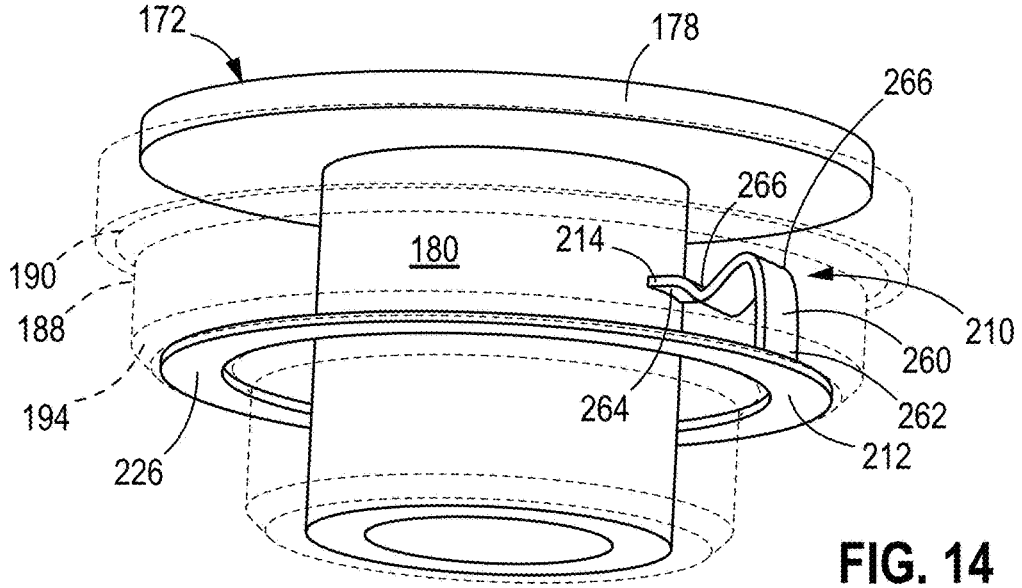
FIG. 14 is a perspective view of another embodiment of an elastomeric member with an electric circuit.
Figure 15:
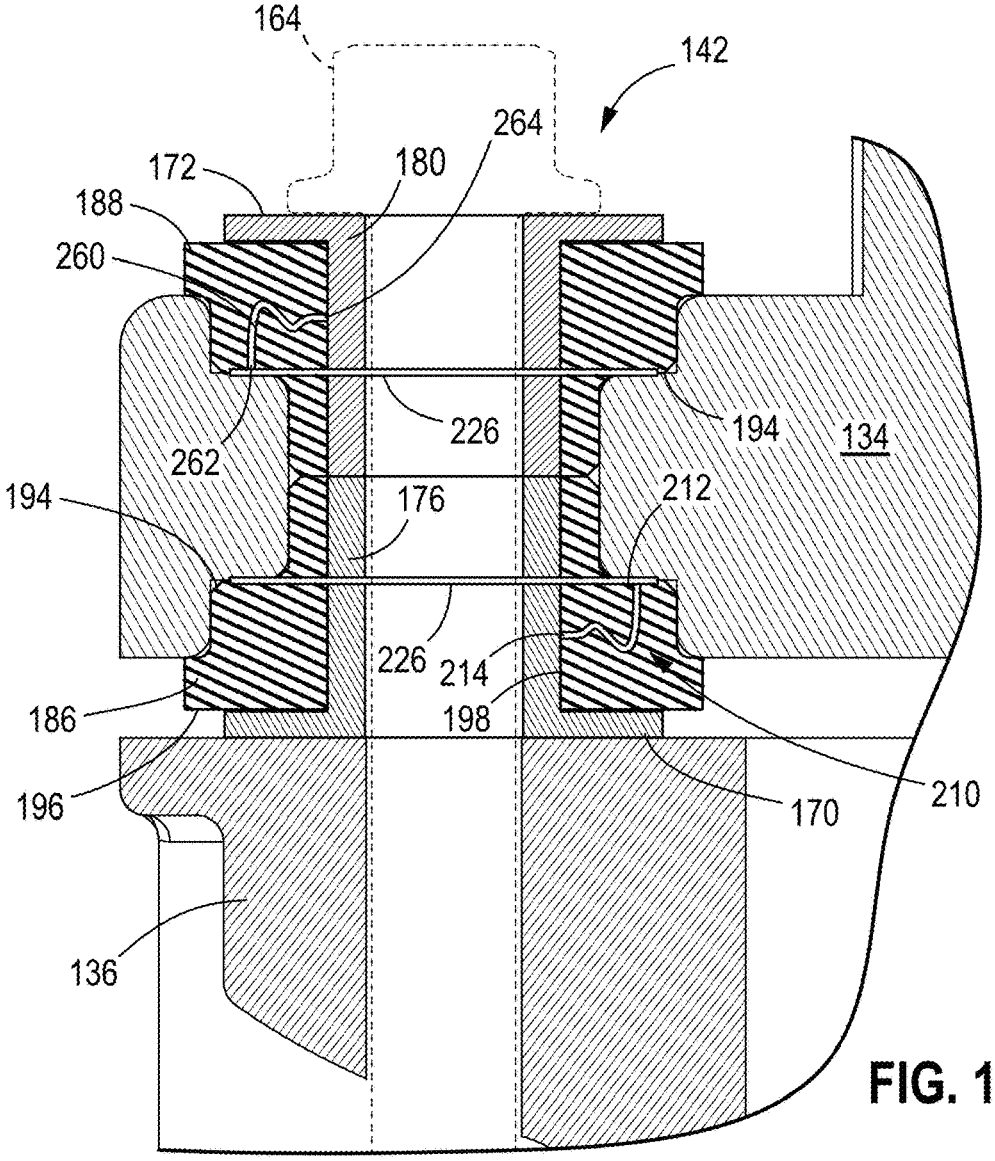
FIG. 15 is a closer view of a portion of Section 3-3 with the elastomeric member of FIG. 14.
Figure 16:
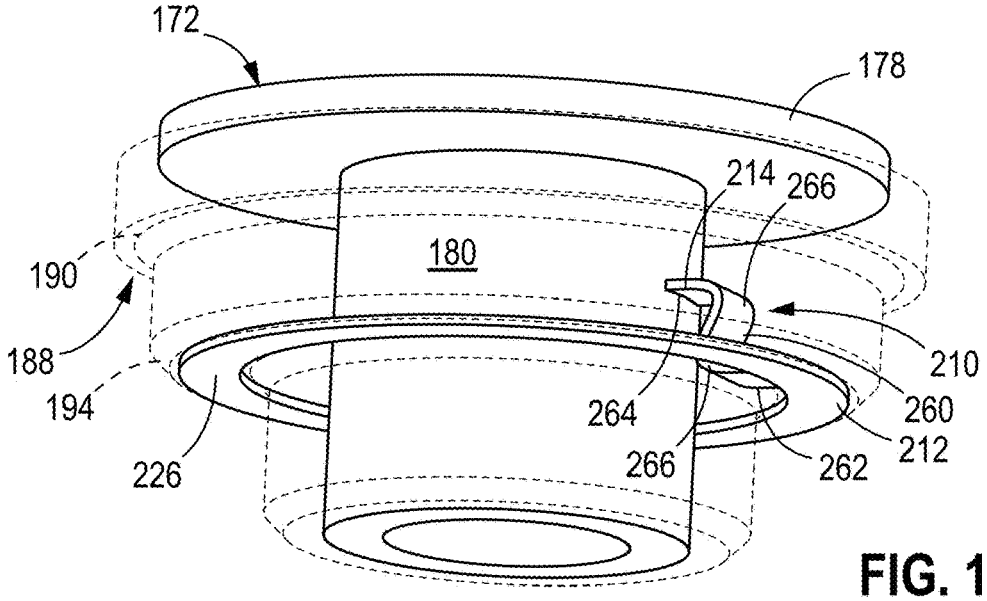
FIG. 16 is a perspective view of another embodiment of an elastomeric member with an electric circuit.
Figure 17:
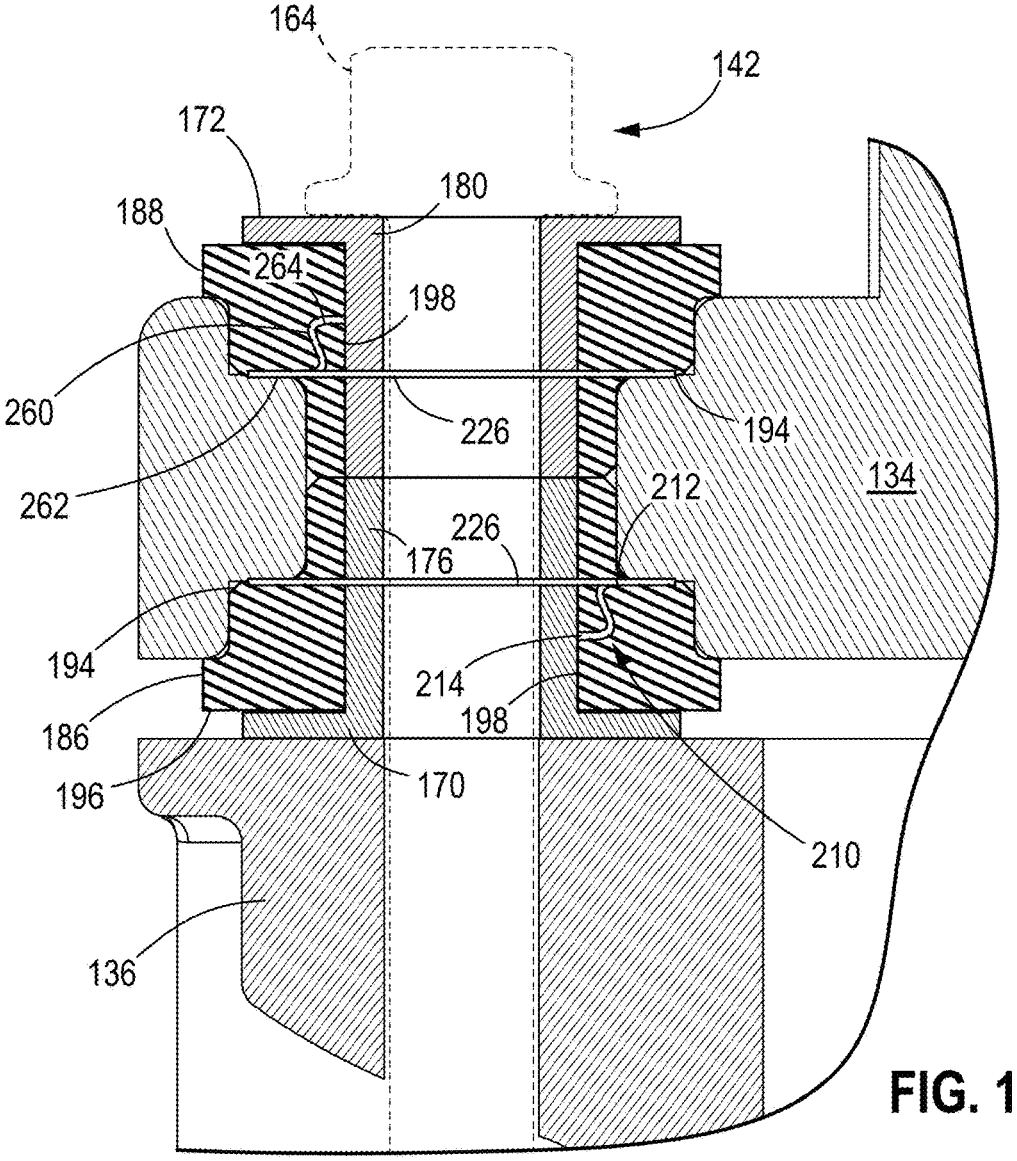
FIG. 17 is a closer view of a portion of Section 3-3 with the elastomeric member of FIG. 16.

Referring to FIG. 13, which depicts an assembled isolating connector assembly 142, the resilient portions 186, 188 are received in the counterbored hole 146 in the frame mounting flange 134 such that the conductive plate 226 at the first end 212 of each electric circuit 210 is in contact with the frame mounting flange 134 and the second end 214 of each electric circuit 210 is in contact with a corresponding one of the first and second cylinder halves 176, 180 of the compression limiter 162. Thus, the electric circuit 210 in each resilient portion 186, 188 extends from a first flange surface 194 of the annular flange 190, which is in contact with the support leg 32 of the supporting frame 12, to a corresponding cylinder half 176, 180 of the compression limiter 162, which is in contact with the leg mounting flange 136.

FIGS. 14-17 illustrate additional embodiments of electric circuits 210 including a conductive strip 260 that extends from a first end 262 connected to a conductive plate 226 at the first flange surface 194 to a second end 264 at the bore surface 198 and abuts a cylinder half 176, 180 of the compression limiter 162. Each of the conductive strips 260 extends in a curved path through one of the resilient portions 186, 188 and includes multiple bends 266 that allow the conductive strips 260 to act as a spring.

In FIGS. 5, 7, 9, 11, 13, 15, and 17, the illustrated isolating connector assembly 142 includes an elastomeric member 160 with two resilient portions 186, 188 that each include an electric circuit 210. Some embodiments of an isolating connector assembly, however, may be configured with only one resilient member that includes at least a portion of an electric circuit. Additionally or alternatively, an isolating connector assembly may include two resilient members having different types of electric circuits extending therethrough. For example, an isolating connector assembly may include any combination of two different resilient members illustrated in FIG. 4, 6, 8, 10, 12, 14, or 16. Further still, some embodiments of a vibration dampening joint may include at least one isolating connector assembly that does not include an electric circuit.

To assemble the vibration isolating joint 140 and couple the supporting frame 12 to the lower unit 34, the elastomeric members 160 are inserted into the counterbored holes 146 by placing the first resilient portions 186 in a bottom opening of a counterbored hole 146 and the second resilient portion 188 in a top opening of said counterbored hole 146. The compression limiters 162 are then received in the elastomeric members 160 by inserting the first cylinder halves 176 into the bores 192 of the first resilient portions 186 and the second cylinder halves 180 into the bores 192 of the second resilient portions 188. The fasteners 164 are then inserted into the elastomeric members 160 and the compression limiters 162 so that the fasteners 164 extend through the first limiter portion 170, the first resilient portion 186, the second limiter portion 172, and the second resilient portion 188. The fasteners 164 extend through the elastomeric members 160 and the compression limiters 162 to engage the bore 148 formed in the leg mounting flange 136.

Tightening the fasteners 164 clamps the elastomeric members 160 between the extension leg 44 and the supporting frame 12 until engagement between the fasteners 164 and the compression limiters 162 prevents further tightening of the fasteners 164. In the non-limiting illustrated embodiments, tightening of the fastener 164 clamps the first resilient portion 186 between the first limiter portion 170 of the compression limiter 162 and the frame mounting flange 134, and the second resilient portion 188 is clamped between the second limiter portion 172 and the frame mounting flange 134. The axial space 182 between the first and second annular flanges 174, 178 of the compression limiters 162 has a length which is preselected to prevent over compression of the elastomeric member 160 by the fastener 164. Thus, the compression limiters 162 prevent over tightening of the fasteners 164 to prevent over compression of the elastomeric member 160. The elastomeric members 160, which are clamped between the extension leg 44 and the supporting frame 12, advantageously limit the transfer of vibrations from the extension leg 44 to the supporting frame 12. All vibrations emanating from the electric motor are transferred to the elastomeric member 160 before being transferred to the supporting frame 12, thereby reducing problematic noise and increasing overall noise quality. The compression limiters 162 prevent over clamping of the elastomeric member during assembly of the extension leg 44 and the propulsor housing 42. By limiting compression of the elastomeric members 169, a predetermined pressure can be loaded onto the elastomeric members. The predetermined load may be selected to limit the transmission of undesirable sound frequencies through the elastomeric members 160 while still supporting the loads needed for propulsion. This may be useful, for example, in order to lower aquatic noise levels to produce less disturbance to boaters, inhabitants, and/or wildlife.

Tightening the fasteners 164 additionally ensures that the electric circuits 210 (or a single electric circuit, in some embodiments) of the anti-fouling system are in electrical communication with both the supporting frame 12 and the propulsor housing 42. As the fasteners 164 are tightened, the first ends 212 of the electric circuit are pressed against the frame mounting flange 134, thereby connecting the electric circuit 210 to the supporting frame 12. The second ends 214 of the electric circuits 210, which are either in contact with the cylinder halves 176, 180 (See FIGS. 13, 15, and 17) or the annular flanges 174, 178 (see FIGS. 5, 7, 9, and 11) of the compression limiters 162, connect the electric circuit 210 to the propulsor housing 42 through the compression limiters 162. Thus, the electric circuits 210 create a conductive path between the frame mounting flange 134 and the leg mounting flange 136 so that electricity is conveyed from the power source to the propulsor housing 42 in order to prevent fouling of the propulsor housing 42.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A marine drive for propelling a marine vessel in a body of water, the marine drive comprising:

a frame configured to support the marine drive with respect to the marine vessel;

a propulsor housing coupled to the frame, the propulsor housing being configured to support a propulsor for generating a propulsive force in the body of water;

a vibration dampening joint which couples the propulsor housing to the frame or an extension thereof, the vibration dampening joint comprising an isolator connector assembly having an elastomeric member which is clamped between the propulsor housing and the frame or the extension thereof such that all vibrations emanating from the propulsor housing pass through the elastomeric member prior to being transferred to the frame or the extension thereof;

a power source for providing electricity; and an electric circuit having a first end coupled to the power source and an opposite, second end coupled to the propulsor housing, the electric circuit being configured to convey electricity from the power source to the propulsor housing and thus prevent fouling thereof, wherein the electric circuit extends through the vibration dampening joint.

2. The marine drive according to claim 1, wherein the electric circuit extends through the elastomeric member.

3. The marine drive according to claim 1, wherein the elastomeric member includes a bore extending through the elastomeric member, and wherein the electric circuit extends from the bore to a flange surface of the elastomeric member.

4. The marine drive according to claim 3, wherein the electric circuit comprises a spring with a first end at the flange surface of the elastomeric member and a second end at a radially inner surface of the elastomeric member.

5. The marine drive according to claim 4, wherein the first end of the spring is in contact with a conductive plate positioned at the flange surface.

6. The marine drive according to claim 1, wherein the elastomeric member includes a flange portion which abuts one of the frame and the propulsor housing, and wherein the electric circuit extends from a first flange surface of the flange portion to a second flange surface of the flange portion opposite the first flange surface.

7. The marine drive according to claim 6, wherein the electric circuit comprises a spring with a first end at the first flange surface of the flange portion and a second end at the second flange surface of the flange portion.

8. The marine drive according to claim 7, wherein the elastomeric member includes a bore extending through the elastomeric member, and wherein the spring is a coil spring which extends circumferentially around the bore between the first end of the spring and the second end of the spring.

9. The marine drive according to claim 6, wherein the electric circuit comprises a circular conductive plate positioned at one of the first flange surface of the flange portion and the second flange surface of the flange portion.

10. The marine drive according to claim 1, wherein the electric circuit comprises a flexible, conductive strip extending in a curved path through the vibration dampening joint.

11. The marine drive according to claim 1, wherein the isolator connector assembly includes a compression limiter which prevents over clamping of the elastomeric member during assembly of the frame and the propulsor housing;

wherein the elastomeric member is clamped between the compression limiter and one of the frame and the propulsor housing; and wherein the electric circuit extends through the elastomeric member from the one of the frame and the propulsor housing to the compression limiter.

12. A system for antifouling of a marine drive having a frame coupled to a propulsor housing, the system comprising:

a vibration dampening joint which couples the propulsor housing to the frame or an extension thereof, the vibration dampening joint comprising an isolator connector assembly having an elastomeric member which is clamped between the propulsor housing and the frame or the extension thereof such that all vibrations emanating from the propulsor housing pass through the elastomeric member prior to being transferred to the frame or the extension thereof;

a power source for providing electricity supported on the frame; and an electric circuit having a first end coupled to the power source and an opposite, second end coupled to the propulsor housing, the electric circuit being configured to convey electricity from the power source to the propulsor housing and thus prevent fouling thereof, wherein the electric circuit extends through the vibration dampening joint.

13. The system according to claim 12, wherein one of the first end of the electric circuit and the second end of the electric circuit is in contact with a mounting flange of a corresponding one of the frame and the propulsor housing.

14. The system according to claim 12, wherein the elastomeric member includes a flange portion and the electric circuit is connected to a first conductive plate at one of a first surface of the flange portion or a second surface of the flange portion.

15. The system according to claim 12, wherein the isolator connector assembly comprises a compression limiter which prevents over clamping of the elastomeric member during assembly of the frame and the propulsor housing, and wherein one of the first end of the electric circuit and the second end of the electric circuit is connected to the compression limiter.

16. The system according to claim 15, wherein the elastomeric member includes a flange portion clamped between the compression limiter and one of the frame and the propulsor housing, and wherein the electric circuit extends from a first flange surface of the flange portion in contact with the one of the frame and the propulsor housing to a second flange surface in contact with the compression limiter.

17. A compression limiting joint for coupling a frame of a marine drive to a propulsor housing of the marine drive, the compression limiting joint comprising:

an isolating connector assembly comprising:

an elastomeric member which is clamped between the frame and the propulsor housing and configured to limit transfer of vibrations from the propulsor housing to the frame, a compression limiter which prevents over clamping of the elastomeric member during assembly of the frame and the propulsor housing; and an electric circuit configured to provide a conductive path between a power source on the frame and the propulsor housing, the electric circuit extending through the elastomeric member from a first end in electrical communication with a first one of the frame and the propulsor housing to a second end in electrical communication with a second one of the frame and the propulsor housing.

18. The compression limiting joint according to claim 17, wherein the first end of the electric circuit is electrically connected to a mounting flange of the first one of the frame and the propulsor housing and the second end of the electric circuit is electrically connected to the compression limiter.

19. The compression limiting joint according to claim 18, wherein the elastomeric member includes a flange portion and the compression limiter extends through a bore formed in the elastomeric member, and wherein the first end of the electric circuit is at a flange surface of the flange portion and the second end of the electric circuit is at a bore surface of the bore.

20. The compression limiting joint according to claim 18, wherein the elastomeric member includes a flange portion clamped between the compression limiter and the mounting flange, and wherein the first end of the electric circuit is at a first flange surface of the flange portion and the second end of the electric circuit is at a second flange surface of the flange portion.

* * * * *